US011482781B2

(12) United States Patent
Huang

(10) Patent No.: US 11,482,781 B2
(45) Date of Patent: Oct. 25, 2022

(54) ELECTROMAGNETIC WAVE ADJUSTING DEVICE

(71) Applicant: Innolux Corporation, Miao-Li County (TW)

(72) Inventor: Zhi-Fu Huang, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/083,321

(22) Filed: Oct. 29, 2020

(65) Prior Publication Data

US 2021/0135360 A1 May 6, 2021

Related U.S. Application Data

(60) Provisional application No. 62/930,071, filed on Nov. 4, 2019.

(30) Foreign Application Priority Data

Jul. 24, 2020 (CN) ..... 202010720875.4

(51) Int. Cl.
*H01Q 3/44* (2006.01)
*H01Q 15/00* (2006.01)
*H01Q 1/36* (2006.01)

(52) U.S. Cl.
CPC ..... *H01Q 3/44* (2013.01); *H01Q 1/364* (2013.01); *H01Q 15/0066* (2013.01); *H01Q 15/0086* (2013.01)

(58) Field of Classification Search
CPC ..... H01Q 1/364; H01Q 1/36; H01Q 1/38; H01Q 15/00; H01Q 15/0066; H01Q 15/0086; H01Q 3/44
See application file for complete search history.

(56) References Cited

U.S. PATENT DOCUMENTS 10,658,762 B2 * 5/2020 Paulotto ..... H01Q 9/0435
11,233,301 B2 * 1/2022 Wang ..... H01Q 1/22
(Continued)

FOREIGN PATENT DOCUMENTS

CN 209544568 U * 10/2019 ..... G02F 1/1303
CN 107331973 B * 2/2021
KR 100917847 B1 * 9/2009 ..... H01Q 13/18

OTHER PUBLICATIONS

Office Action of China Counterpart Application, dated Jul. 18, 2022, pp. 1-6.

*Primary Examiner* — Tho G Phan
(74) *Attorney, Agent, or Firm* — JCIPRNET

(57) ABSTRACT

The disclosure provides an electromagnetic wave adjusting device, including a first substrate, a first conductive element, a second substrate, a second conductive element, and a dielectric layer. The first conductive element is disposed on the first substrate. The second substrate is opposite to the first substrate. The second conductive element is disposed on the second substrate and faces the first substrate, in which the first conductive element has an overlapping region which overlaps the second conductive element. The dielectric layer is disposed between the first substrate and the second substrate. The electromagnetic wave adjusting device includes a working region and a non-working region. The working region includes the overlapping region. The non-working region is disposed outside the working region. A first region in the non-working region and a second region in the working region have the same film-layer stack structure.

19 Claims, 2 Drawing Sheets

(56) References Cited

U.S. PATENT DOCUMENTS

| | | | | |
|---|---|---|---|---|
| 2010/0090903 | A1 | 4/2010 | Byun et al. | |
| 2014/0022029 | A1 * | 1/2014 | Glushchenko | H01P 1/184 977/773 |

* cited by examiner

ELECTROMAGNETIC WAVE ADJUSTING DEVICE

CROSS-REFERENCE TO RELATED APPLICATION

This application claims the priority benefits of U.S. provisional application Ser. No. 62/930,071, filed on Nov. 4, 2019 and China application serial no. 202010720875.4, filed on Jul. 24, 2020. The entirety of each of the above-mentioned patent applications is hereby incorporated by reference herein and made a part of this specification.

BACKGROUND

Technical Field

The disclosure relates to an electromagnetic wave adjusting device, particularly to an antenna device.

Description of Related Art

Electromagnetic wave adjusting devices (such as an antenna device, etc.) are an indispensable part in wireless communication technology. Taking a wireless communication device adopting a liquid crystal antenna as an example, two layers of conductive elements are disposed respectively on two substrates, and the liquid crystal material is filled between the two substrates. During the process of manufacturing the liquid crystal antenna, the variation (such as thickening) of the film thickness induced by the manufacturing process causes the space for accommodating the liquid crystal material to change (to shrink, for example). If the same amount of liquid crystal material is filled into the space for accommodating the liquid crystal material, unexpected reduction of the space would cause the substrate to be squeezed by the liquid crystal material and thus deform, resulting in regional differences in the overall cell gap of the liquid crystal antenna. Therefore, after filling the liquid crystal material, it is necessary to measure the cell gaps in different regions of the liquid crystal antenna to determine if the manufactured liquid crystal antenna meets the specifications.

SUMMARY

According to the embodiments of the present disclosure, an electromagnetic wave adjusting device includes a first substrate, a first conductive element, a second substrate, a second conductive element, and a dielectric layer. The first conductive element is disposed on the first substrate. The second substrate is opposite to the first substrate. The second conductive element is disposed on the second substrate and faces the first substrate, in which the first conductive element has an overlapping region which overlaps the second conductive element. The dielectric layer is disposed between the first substrate and the second substrate. The electromagnetic wave adjusting device includes a working region and a non-working region. The working region includes the overlapping region. The non-working region is disposed outside the working region. A first region of the non-working region and a second region of the working region have the same film-layer stack structure.

The embodiments accompanied with drawings are described below in detail to provide a further understanding of the aforementioned features and the advantages of the disclosure.

BRIEF DESCRIPTION OF THE DRAWINGS

The accompanying drawings are included to provide a further understanding of the disclosure and are incorporated in and constitute a part of this specification. The drawings illustrate embodiments of the disclosure and, together with the description, serve to explain the principles of the disclosure.

DESCRIPTION OF THE EMBODIMENTS

Figure 1:
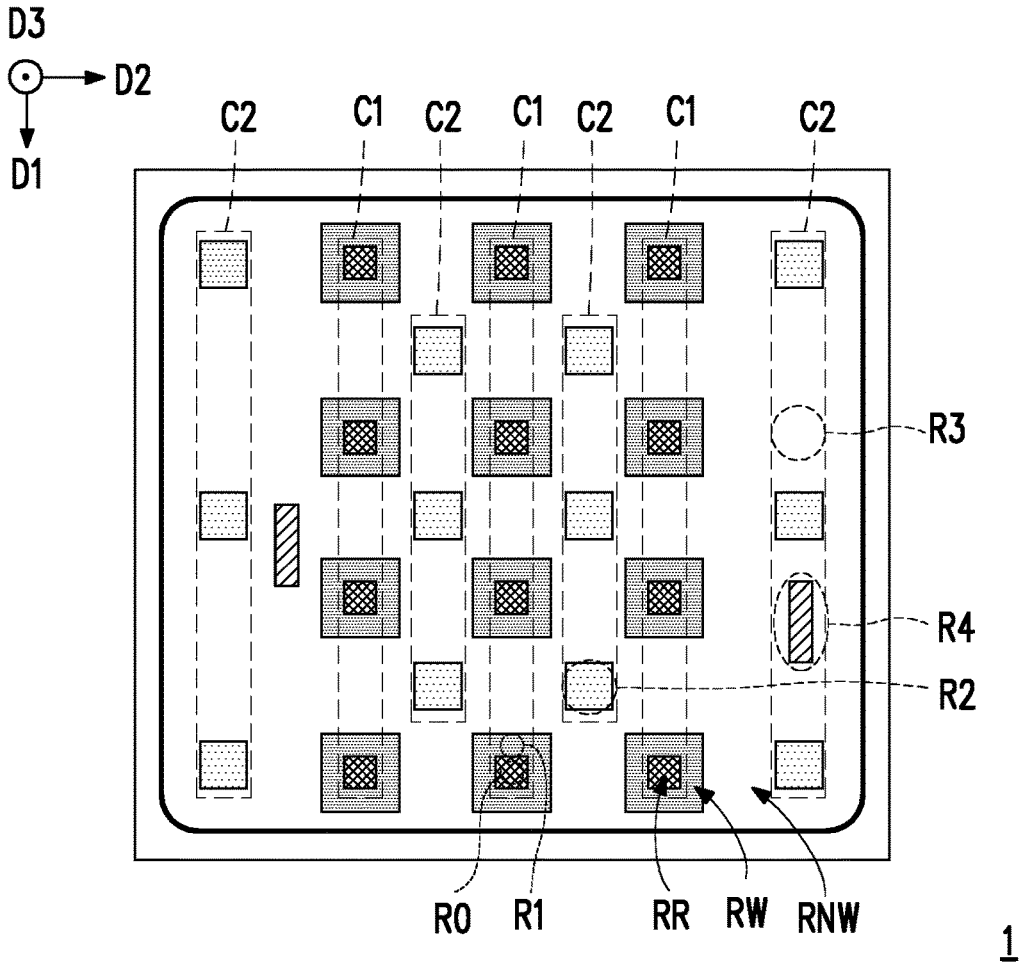
FIG. 1 is a top schematic view of a part of an electromagnetic wave adjusting device according to an embodiment of the disclosure.

The disclosure may be understood by referring to the following detailed description and the accompanying drawings. It should be duly noted that, for the ease of the readers' comprehension and the simplicity of the drawings, multiple drawings of the present disclosure only illustrate parts of the electronic device/display device, and the specific elements in the drawings are not drawn to the actual scale ratio. Also, the number and the size of each element in the drawings are only for schematic purposes, and do not limit the scope of the disclosure. For example, the relative size, thickness, and location of each film layer, region, and/or structure may be reduced or enlarged for the sake of clarity.

Throughout the specification and the appended claims of the present disclosure, certain terms are adopted to refer to specific elements. Those skilled in the art should understand that electronic device manufacturers may refer to the same components by different names. And the present disclosure does not intend to distinguish between those elements having the same function but with different names. In the following specification and claims, the words "comprise," "include," and the likes are open-ended words, so they should be interpreted as "including but not limited to."

Wordings used to indicate directions in this article, such as "up," "down," "front," "back," "left," and "right" merely refer to the directions in the drawings. Therefore, the directional wordings are used to illustrate rather than limit the disclosure. It should be understood that when an element or a film layer is referred to being "on" or "connected to/with" another element or film layer, the element or the film layer may be directly on or directly connected to/with the other element or film layer, or there could also be an element or film layer inserted between the two (such that they are connected indirectly). On the contrary, when an element or a film layer is indicated to be "directly on" or "directly connected to/with" another element or film layer, there is no element or film layer existing between the two.

The terms "approximately," "equal to," "equivalent," "same," "substantially," or "generally" used in this article usually represent a 10% range of a given value, or a 5%, 3%, 2%, 1%, or 0.5% range of a given value. Furthermore, unless specified otherwise, the expressions such as "the given range ranges from the first value to the second value" and "the given value falls within the range of the first value to the second value" indicate that the given range includes the first value, the second value, and other values in between.

In some embodiments of the disclosure, unless defined specifically, terms relating to bonding and connection, such as "connected," "interconnected," etc., mean that the two structures are in direct contact, that the two structures are not in direct contact, or that there is other structure disposed between the two structures. The terms relating to bonding and connection may also include the situation in which both structures are movable or both structures are fixed. In addition, the terms "electrically connected" and "coupling" include any direct and indirect means of making an electrical connection.

In the following embodiments, the same or similar elements are designated with the same or similar reference signs, and descriptions thereof are omitted. In addition, features of different embodiments may be adopted in combination with one another at will, provided that they do not violate the spirit of the disclosure or be in conflict with one another. And simple equivalent changes and modifications made according to the specification or the claims are within the scope of the disclosure. Moreover, the terms such as "first" and "second" mentioned in the specification or the claims are only used to name different elements or to distinguish between different embodiments or scopes, instead of putting an upper or a lower limit on the number of the elements, nor are they intended to limit the manufacturing order or disposition order of the elements.

The electronic device of the present disclosure may include an electromagnetic wave adjusting device (such as an antenna device) or an electronic device having an electromagnetic wave adjusting element (such as an antenna), but is not limited thereto. The electronic device may include a bendable or flexible electronic device. Hereinafter, the electronic device is referred to as an electromagnetic wave adjusting device to expound the content of the disclosure, but the disclosure is not limited thereto.

Figure 2:
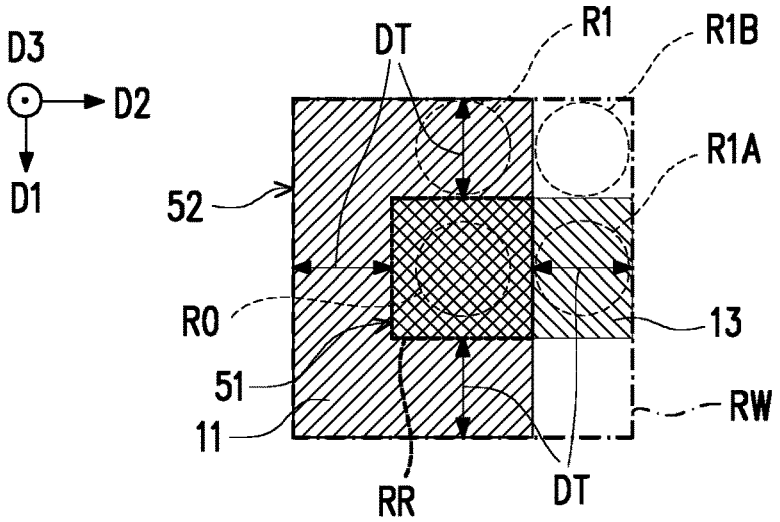
FIG. 2 is a enlarged schematic view of the overlapping region and the working region according to FIG. 1.
Figure 3:
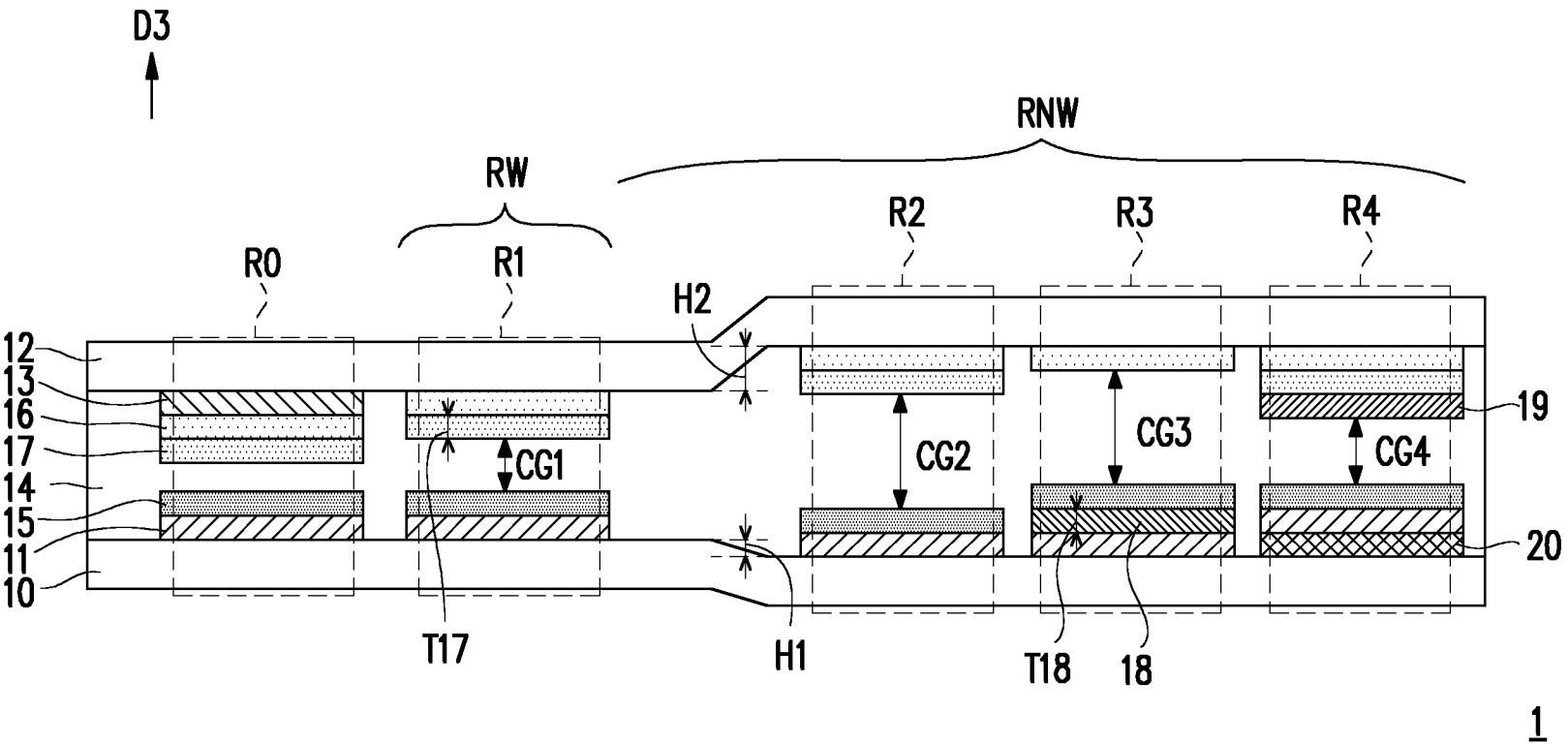
FIG. 3 is a schematic cross-sectional view of the Region R0 to the Region R4 according to FIG. 1.

FIG. 1 is a top schematic view of a part of an electromagnetic wave adjusting device according to an embodiment of the disclosure. FIG. 2 is a enlarged schematic view of the overlapping region and the working region according to FIG. 1. FIG. 3 is a schematic cross-sectional view of the Region R0 to the Region R4 according to FIG. 1.

In FIG. 1 to FIG. 3, an electromagnetic wave adjusting device 1 includes a first substrate 10, a first conductive element 11, a second substrate 12, a second conductive element 13, and a dielectric layer 14.

The first substrate 10 is adapted to carry elements or film layers. For example, the material of the first substrate 10 may include plastic or glass, but is not limited thereto.

The first conductive element 11 is disposed on the first substrate 10. The first conductive element 11 may be a single-layered conductive film or stacked layers of a multi-layered conductive film. For example, the material of the first conductive element 11 may include metal, alloy, or a combination thereof, but is not limited thereto.

The second substrate 12 is disposed opposite to the first substrate 10. Specifically speaking, the second substrate 12 overlaps the first substrate 10 in a normal direction D3 of the electromagnetic wave adjusting device 1. The second substrate 12 is adapted to carry elements or film layers. For example, the material of the second substrate 12 may include plastic or glass, but is not limited thereto.

The second conductive element 13 is disposed on the second substrate 12 and faces the first substrate 10. In other words, the second conductive element 13 is disposed between the second substrate 12 and the first substrate 10. The second conductive element 13 may be a single-layered conductive film or stacked layers of a multi-layered conductive film. For example, the material of the second conductive element 13 may include metal, alloy, or a combination thereof, but is not limited thereto.

The first conductive element 11 has an overlapping region RR which overlaps with the second conductive element 13. In some embodiments, the electromagnetic wave adjusting device 1 may include a plurality of second conductive elements 13. Correspondingly, the first conductive element 11 may have a plurality of overlapping regions RR which overlap with the plurality of second conductive elements 13. According to some embodiments, the number and the configuration of the overlapping regions RR as well as the top-viewed shape of each overlapping region RR may be changed according to needs, and are not limited to those shown in FIG. 1 and FIG. 2. For example, in addition to a quadrilateral shape, the top-viewed shape of the overlapping region RR may also be a circle, an ellipse, or other shapes.

The dielectric layer 14 is disposed between the first substrate 10 and the second substrate 12. A suitable dielectric layer 14 may be selected according to the category of application of the electromagnetic wave adjusting device 1. For example, the dielectric layer 14 may include a liquid crystal layer, and the electromagnetic wave adjusting device 1 may be adapted as a liquid crystal antenna, but is not limited thereto. The liquid crystal layer may include twisted nematic liquid crystal (TN LC), vertical alignment liquid crystal (VA LC), and in-plane switching liquid crystal (IPS LC), or other types of liquid crystal.

According to different needs, the electromagnetic wave adjusting device 1 may further include other elements or film layers. For example, as shown in FIG. 3, the electromagnetic wave adjusting device 1 may optionally include a light-transmitting layer 15, a light-transmitting layer 16, a light-transmitting layer 17, a light-transmitting layer 18, a metal layer 19, and a metal layer 20, but it is not limited thereto.

The light-transmitting layer 15 is disposed on the first conductive element 11 and is disposed between the dielectric layer 14 and the first conductive element 11. The light-transmitting layer 15 may be an insulating layer. For example, the material of the insulating layer may include organic insulating material, inorganic insulating material, or a combination of the two, but is not limited thereto. In other embodiments, the light-transmitting layer 15 may be a conductive layer. The material of the conductive layer may include metal oxide, graphene, metal mesh, or other suitable light-transmitting conductive materials.

The light-transmitting layer 16 is disposed on the second substrate 12 and is disposed between the dielectric layer 14 and the second substrate 12. In the region R0, the second conductive element 13 is disposed between the light-transmitting layer 16 and the second substrate 12. The light-transmitting layer 16 may be an insulating layer. For example, the material of the insulating layer may include organic insulating material, inorganic insulating material, or a combination of the two, but is not limited thereto. In other embodiments, the light-transmitting layer 16 may be a conductive layer. The material of the conductive layer may include metal oxide, graphene, metal mesh, or other suitable light-transmitting conductive materials.

The light-transmitting layer 17 is disposed on the light-transmitting layer 16 and is disposed between the dielectric layer 14 and the light-transmitting layer 16. The light-transmitting layer 17 may be an insulating layer. The material of the insulating layer may include organic insulating material, inorganic insulating material, or a combination of the two, but is not limited thereto. In other embodiments, the light-transmitting layer 17 may be a conductive layer. The material of the conductive layer may include metal oxide, graphene, metal mesh, or other suitable light-transmitting conductive materials.

The light-transmitting layer 18 is disposed on the first conductive element 11 and is disposed between the light-transmitting layer 15 and the first conductive element 11. The light-transmitting layer 18 may be an insulating layer. The material of the insulating layer may include organic insulating material, inorganic insulating material, or a combination of the two, but is not limited thereto. In other embodiments, the light-transmitting layer 18 may be a conductive layer. The material of the conductive layer may include metal oxide, graphene, metal mesh, or other suitable light-transmitting conductive materials.

The light-transmitting layer 19 is disposed on the light-transmitting layer 17 and is disposed between the dielectric layer 14 and the light-transmitting layer 17.

The metal layer 20 is disposed on the first substrate 10 and is disposed between the first conductive element 11 and the first substrate 10.

It should be noted that the configuration of the relative relations between the first substrate 10, the first conductive element 11, the second substrate 12, the second conductive element 13, the dielectric layer 14, the light-transmitting layer 15, the light-transmitting layer 16, the light-transmitting layer 17, the light-transmitting layer 18, the metal layer 19, and the metal layer 20 in FIG. 3 are only for schematic purposes. The configuration of the relative relations between the elements and/or the film layers in the electromagnetic wave adjusting device 1 may be changed according to needs, and the number of elements and/or film layers in the electromagnetic wave adjusting device 1 may be increased or reduced according to needs.

The electromagnetic wave adjusting device 1 includes a working region RW and a non-working region RNW. According to some embodiments, as shown in FIG. 1, the working region RW may include the overlapping region RR. In the top view of the electromagnetic wave adjusting device 1 as shown in FIG. 1, the overlapping region RR may be disposed in the working region RW, and the non-working region RNW is disposed outside the working region RW. Specifically speaking, the working region RW includes a region where the dielectric layer 14 is affected by the fringe field. As shown in FIG. 2, the boundary of the working region RW (represented by a thick dash-dotted line), for example, is where the edge of the overlapping region RR (represented by a thick dashed line) extends outward by a distance DT along a direction (such as a first direction D1 and a second direction D2) parallel to the substrate. The distance DT refers to the shortest distance between the edge of the overlapping region RR and the corresponding edge of the working region RW. As shown in FIG. 2, the overlapping region RR and the working region RW each have four edges. According to some embodiments, the distance between an edge of the overlapping region RR and an edge of the working region RW may be the distance DT. For example, the distance between an edge of the overlapping region RR and the corresponding edge of the working region RW may be the distance DT. As shown in FIG. 2, the distance DT between an edge 51 of the overlapping region RR and a corresponding edge 52 of the working region RW may be the shortest distance in a direction (for example, the second direction D2). In some embodiments, the distance DT may be greater than 0 micrometer and less than or equal to 1000 micrometers, such as being greater than 0 micrometer and less than or equal to 100 micrometers, or being greater than 10 micrometers and less than or equal to 100 micrometers, but is not limited thereto. In addition, under the structure of the plurality of overlapping regions RR as shown in FIG. 1, the electromagnetic wave adjusting device 1 also includes a plurality of working regions RW, and the plurality of overlapping regions RR are disposed respectively in the plurality of working regions RW. The entire region outside the working regions RW is termed as the non-working region RNW. According to some embodiments, the four edges of the overlapping region RR extend outward by the distance DT to form the four edges of the working regions RW. For example, the edge 51 of the overlapping region RR extends outward by the distance DT to form the edge 52 of the working region RW. The distances DT corresponding to the four edges may be the same with or different from one another according to the designs of different embodiments.

After filling the dielectric layer 14 (for example, with liquid crystal material), any known optical measurement method may be adopted to measure the cell gaps of the working region RW and the non-working region RNW to calculate the cell-gap difference between the cell gap of the working region RW and the cell gap of the non-working region RNW, thereby determining if the manufactured electromagnetic wave adjusting device 1 meets the specifications. The optical measurement method may be performed by a machine capable of measuring cell gaps, and the machine may include a cell gap measuring machine, a polarization meter, etc., but is not limited thereto.

FIG. 3 schematically illustrates that the first substrate 10 and the second substrate 12 in the non-working region RNW are deformed in the normal direction D3 of the electromagnetic wave adjusting device 1 respectively. If the deformation amount of the first substrate 10 in the normal direction D3 of the electromagnetic wave adjusting device 1 is H1, and the deformation amount of the second substrate 12 in the normal direction D3 of the electromagnetic wave adjusting device 1 is H2, then the total deformation of the first substrate 10 and the second substrate 12 in the normal direction D3 of the electromagnetic wave adjusting device 1 in the non-working region RNW is the sum of H1 and H2. The cell-gap difference between the cell gap of the working region RW and the cell gap of the non-working region RNW may reflect the total deformation amount of the first substrate 10 and the second substrate 12 in the normal direction D3 of the electromagnetic wave adjusting device 1. Cell gap refers to the distance between the film layer which is disposed on the first substrate 10 and furthest away from the first substrate 10 and the film layer which is disposed on the second substrate 12 and furthest away from the second substrate 12 in the normal direction D3 of the electromagnetic wave adjusting device 1. The distance may vary due to the different stack structures of the film layers.

In the cross-sectional view of the electromagnetic wave adjusting device 1 as shown in FIG. 3, in the non-working region RNW, there may have a variety of film-layer stack structure due to the needs of design. FIG. 3 schematically illustrates three types of film-layer stack structure in the non-working region RNW (as shown in the region R2 to the region R4), but the types of film-layer stack structure in the non-working region RNW may be increased or reduced according to needs and are not being limited to the illustration of FIG. 3.

In the present disclosure, if two regions have the same film-layer stack structure, it is indicated that the two regions have the same film layers. In contrast, if two regions have different film-layer stack structures, it is indicated that the two regions have different film layers in terms of, for example, different number of film layers, different stacking method of film layers, or different types of film layers. Taking the region R1 and the region R2 for example, the region R2 and the region R1 have the same film-layer stack structure, the film-layer stack structure in both regions includes the first substrate 10, the first conductive element 11, the light-transmitting layer 15, the dielectric layer 14, the light-transmitting layer 17, the light-transmitting layer 16, and the second substrate 12. In contrast, the region R3 and the region R1 have different film-layer stack structures, specifically, the film-layer stack structure in the region R3 further includes the light-transmitting layer 18 but does not include the light-transmitting layer 17. Similarly, the region R4 and the region R1 have different film-layer stack structures, specifically, the film-layer stack structure in the region R4 further includes the metal layer 19 and the metal layer 20.

If a region in the non-working region RNW (such as the region R3 or the region R4, in which the film-layer stack structure is different from that of the measurement region of the working region RW (such as the region R1)) is selected randomly to perform an optical measurement and to determine if the electromagnetic wave adjusting device 1 meets the specifications based on the measured cell gaps, interpretation errors and even the failure to perform an optical measurement may happen.

Specifically speaking, since the film-layer stack structure in the region R3 further includes the light-transmitting layer 18 but does not include the light-transmitting layer 17 compared to the region R1, the cell-gap difference between the cell gaps of the region R3 and the region R1 includes not only the total deformation amount (H1+H2) of the first substrate 10 and the second substrate 12 in the normal direction D3 of the electromagnetic wave adjusting device 1 but also the difference between a thickness T17 of the light-transmitting layer 17 and a thickness T18 of the light-transmitting layer 18, that is, CG3−CG1=H1+H2+T17−T18, in which CG3 is the cell gap in the region R3, and CG1 is the cell gap in the region R1. However, the thickness of the film layers (such as the thickness T17 and the thickness T18) may vary due to process factors, such that the calculated cell-gap difference is different from the actual cell-gap difference. Therefore, the difference between the film-layer stack structures in different measurement regions may easily affect the detection result and cause interpretation errors. In addition, at least one side of the dielectric layer 14 must be light-transmitting to allow the cell gap to be measured using an optical method. Since metal layers (the metal layer 19 and the metal layer 20) are disposed on the opposite side of the dielectric layer 14 in the region R4, the opposite side of the dielectric layer 14 is not light-transmitting and thus a cell gap CG4 cannot be measured using an optical method.

In the embodiments of the disclosure, the non-working region RNW is disposed with a measurement region (for example, the region R2, which may also be referred to as a first region) that has the same film-layer stack structure with the one in the measurement region in the working region RW (for example, the region R1, which may also be referred to as a second region). Therefore, after obtaining the difference between the cell gaps measured by the two measurement regions, the cell-gap difference between the cell gap of the non-working region RNW and the cell gap of the working region RW is thus obtained, that is, CG2−CG1=H1+H2, in which CG2 is the cell gap in the region R2. It may be inferred from the above relational expression that, under the framework that the two measurement regions have the same film-layer stack structure, the cell-gap difference between the cell gap in the non-working region RNW and the cell gap in the working region RW depends on the total deformation amount of the first substrate 10 and the second substrate 12 in the normal direction D3 of the electromagnetic wave adjusting device 1. Thus, the aforementioned negative influence on the detection result due to the difference between different film-layer stack structures may be prevented, thereby improving the accuracy of the detection result.

As shown in FIG. 1, in some embodiments, the first region (such as the region R2) in the non-working region RNW may be disposed among a plurality of working regions RW. In some embodiments, the non-working region RNW may have a plurality of first region (such as the region R2), that is, a plurality of measurement regions for optical detection may be disposed in the non-working region RNW. In some embodiments, the overlapping regions RR may be arranged in a plurality of columns as first columns C1 along the first direction D1, and a plurality of first regions (such as the regions R2) may be arranged in a plurality of columns as second columns C2 along the first direction D1, and the first columns C1 and the second columns C2 may be arranged alternately in the second direction D2 which intersects the first direction D1. In some embodiments, the second direction D2 is perpendicular to the first direction D1, but is not limited thereto. In other embodiments, the configuration of the relative relations between the overlapping region RR and the first region (such as the region R2) may be changed according to needs, and is not limited to what is shown in FIG. 1.

It should also be noted that although FIG. 3 shows that the film-layer stack structure in each of the first region (such as the region R2) in the non-working region RNW and the second region (such as the region R1) in the working region RW includes a first substrate 10, a first conductive element 11, a light-transmitting layer 15, a dielectric layer 14, a light-transmitting layer 17, a light-transmitting layer 16, and a second substrate 12, the film-layer stack structures (such as the number of film layers or the stacking order) of the two regions are not limited thereto. For example, at least one of the light-transmitting layer 15, the light-transmitting layer 16, and the light-transmitting layer 17 may be omitted, or other film layer may be further included according to needs.

Specifically speaking, the film-layer stack structure of the measurement region (also termed as the first region) in the non-working region RNW may depend on the film-layer stack structure of the selected measurement region (which is also referred to as the second region) in the working region RW. As shown in FIG. 2, the working region RW may have a variety of stack structures of film layers due to the need of design. FIG. 2 schematically indicates with circles the three regions having three types of film-layer stack structures in the working region RW, that is, a region R1, a region R1A, and a region R1B.

According to FIG. 2, the first conductive element 11 is disposed in the region R1, and the second conductive element 13 is disposed outside the region R1 (that is, the film-layer stack structure of the region R1 includes the first conductive element 11 and does not include the second conductive element 13). Furthermore, the second conductive element 13 is disposed in the region R1A, and the first conductive element 11 is disposed outside the region R1A (that is, the film-layer stack structure of the region R1A includes the second conductive element 13 and does not include the first conductive element 11). Also, the first conductive element 11 and the second conductive element 13 are both disposed outside the region R1B (that is, the film-layer stack structure of the region R1B does not include the first conductive element 11 and the second conductive element 13).

In some embodiments, the region R1 may be selected as the measurement region (which is also referred to as the second region) of the working region RW, and the film-layer stack structure of the measurement region (which is also referred to as the first region) in the non-working region RNW may depend on the film-layer stack structure of the region R1. As shown in FIG. 3, the first region (such as the region R2) of the non-working region RNW and the second region (such as the region R1) of the working region RW may include the first conductive element 11, but not include the second conductive element 13. That is, the first conductive element 11 is disposed in the first region and the second region, and the second conductive element 13 is disposed outside the first region and the second region.

In some other embodiments (not illustrated herein), the region R1A may be selected as the measurement region of the working region RW (which is also referred to as the second region), and the film-layer stack structure of the measurement region in the non-working region RNW (which is also referred to as the first region) may depend on the film-layer stack structure of the region R1A. In other words, the first region of the non-working region RNW and the second region of the working region RW may include the second conductive element 13, but not include the first conductive element 11. That is, the second conductive element 13 is disposed in the first region and the second region, and the first conductive element 11 is disposed outside the first region and the second region.

In yet some other embodiments (not illustrated herein), the region R1B may be selected as the measurement region of the working region RW (which is also referred to as the second region), and the film-layer stack structure of the measurement region in the non-working region RNW (which is also referred to as the first region) may depend on the film-layer stack structure of the region R1B. In other words, the first region of the non-working region RNW and the second region of the working region RW may not include the first conductive element 11 and the second conductive element 13. That is, the first conductive element 11 and the second conductive element 13 are both disposed outside the first region and the second region.

In summary, in the embodiments of the present disclosure, the first region in the non-working region and the second region in the working region have the same film-layer stack structure. The cell-gap difference between the cell gap of the non-working region RNW and the cell gap of the working region RW may be calculated directly by calculating the cell-gap difference between the measured cell gaps of the first region and the second region. Thus, the electromagnetic wave adjusting device can be determined if meets the specifications, thereby improving the accuracy of the detection result.

The above embodiments are only used to illustrate the technical solutions of the present disclosure without limiting them; although the present disclosure has been described in detail with reference to the foregoing embodiments, those of ordinary skill in the art should understand that they may still recombine or modify the technical solutions described in each of the foregoing embodiments, or substitute some or all of the technical features with their equivalence; and the entities of those corresponding technical solutions with such combinations, modifications, or substitutions do not deviate from the scope of the technical solutions of the embodiments of the present disclosure.

Although the embodiments and its advantages of the present disclosure have been disclosed as above, it is apparent to those with ordinary skill in the art that modifications, substitution, and polishing may be made without departing from the spirit of the present disclosure, and the features of the embodiments may be mixed and substituted with one another at will to form other new embodiments. Furthermore, the scope of the present disclosure is not limited to the process, machinery, manufacturing, material composition, device, method, and steps of the specific embodiments described in the specification. Anyone with ordinary knowledge in the art may comprehend the process, machinery, manufacturing, material composition, device, method, and steps developed at present or in the future from the present disclosure. Provided that the functions or the results being substantially the same as the ones in the embodiments described herein may be implemented or obtained, they may be adopted according to the present disclosure. Hence, the scope of the present disclosure includes the above-mentioned process, machinery, manufacturing, material composition, device, method, and steps. In addition, each claim also constitutes an individual embodiment, and the scope of the present disclosure also includes the combinations of each claim and each embodiment. The scope of the present disclosure shall be determined by the appended claims.

What is claimed is:

1. An electromagnetic wave adjusting device, comprising:

a first substrate;

a first conductive element, disposed on the first substrate;

a second substrate, disposed opposite to the first substrate;

a second conductive element, disposed on the second substrate and facing the first substrate, wherein the first conductive element comprises an overlapping region which overlaps the second conductive element; and a liquid crystal layer, disposed between the first substrate and the second substrate, wherein the electromagnetic wave adjusting device comprises a working region and a non-working region, the working region comprises the overlapping region, the non-working region is disposed outside the working region, and a first region of the non-working region and a second region of the working region have the same film-layer stack structure, and wherein the first conductive element is located between the first substrate and the liquid crystal layer, and the second conductive element is located between the second substrate and the liquid crystal layer.

2. The electromagnetic wave adjusting device according to claim 1, wherein in a top view of the electromagnetic wave adjusting device, a distance between an edge of the overlapping region and an edge of the working region is greater than 0 micrometer and less than or equal to 1000 micrometers.

3. The electromagnetic wave adjusting device according to claim 1, comprising:

a plurality of second conductive elements, wherein the first conductive element comprises the plurality of overlapping regions which overlap the plurality of second conductive elements; and a plurality of working regions, wherein the plurality of overlapping regions are disposed respectively in the plurality of working regions, wherein the plurality of working regions comprise a first working region and a second working region, the plurality of second conductive elements comprise a second conductive element disposed in the first working region and another second conductive element disposed in the second working region, and the second conductive element and the another conductive element are separated.

4. The electromagnetic wave adjusting device according to claim 3, wherein the first region is disposed among the plurality of working regions.

5. The electromagnetic wave adjusting device according to claim 3, wherein the non-working region comprises the plurality of first regions, wherein the plurality of overlapping regions are arranged in a plurality of first columns along a first direction, the plurality of first regions are arranged in a plurality of second columns along the first direction, and the plurality of first columns and the plurality of second columns are arranged alternately in a second direction intersecting the first direction.

6. The electromagnetic wave adjusting device according to claim 5, wherein the second direction is perpendicular to the first direction.

7. The electromagnetic wave adjusting device according to claim 1, wherein the first conductive element is disposed outside the first region and the second region, and the second conductive element is disposed in the first region and the second region.

8. The electromagnetic wave adjusting device according to claim 1, wherein the second conductive element is disposed outside the first region and the second region, and the first conductive element is disposed in the first region and the second region.

9. The electromagnetic wave adjusting device according to claim 1, wherein the first conductive element and the second conductive element are both disposed outside the first region and the second region.

10. The electromagnetic wave adjusting device according to claim 1, wherein a material of the first conductive element and the second conductive element comprises metal, alloy, or a combination thereof.

11. The electromagnetic wave adjusting device according to claim 1, wherein the first region and the second region comprise the first conductive element and the liquid crystal layer.

12. The electromagnetic wave adjusting device according to claim 11, wherein the first region and the second region further comprise a first light-transmitting layer disposed between the liquid crystal layer and the first conductive element.

13. The electromagnetic wave adjusting device according to claim 11, wherein the first region and the second region further comprise a second light-transmitting layer disposed between the liquid crystal layer and the second substrate.

14. An electromagnetic wave adjusting device, comprising:

a first substrate;

a first conductive element, disposed on the first substrate;

a second substrate, disposed opposite to the first substrate;

a plurality of second conductive elements, disposed on the second substrate and facing the first substrate, wherein the first conductive element comprises a plurality of overlapping regions which overlap the plurality of second conductive elements; and a dielectric layer, disposed between the first substrate and the second substrate, wherein the electromagnetic wave adjusting device comprises a plurality of working regions and a non-working region, the plurality of overlapping regions are disposed respectively in the plurality of working regions, the non-working region is disposed outside the plurality of working regions, wherein the non-working region comprises a plurality of first regions, and the plurality of first regions of the non-working region and a second region of the working region have the same film-layer stack structure, and wherein the plurality of overlapping regions are arranged in a plurality of first columns along a first direction, the plurality of first regions are arranged in a plurality of second columns along the first direction, and the plurality of first columns and the plurality of second columns are arranged alternately in a second direction intersecting the first direction.

15. The electromagnetic wave adjusting device according to claim 14, wherein the first conductive element is disposed outside the plurality of first regions and the second region, and the plurality of second conductive elements are disposed in the plurality of first regions and the second region.

16. The electromagnetic wave adjusting device according to claim 14, wherein the plurality of second conductive elements are disposed outside the plurality of first regions and the second region, and the plurality of first regions and the second region comprise the first conductive element.

17. The electromagnetic wave adjusting device according to claim 14, wherein the first conductive element and the plurality of second conductive elements are disposed outside the plurality of first regions and the second region.

18. The electromagnetic wave adjusting device according to claim 14, wherein one of the plurality of first regions and the second region comprise the first conductive element and the dielectric layer.

19. The electromagnetic wave adjusting device according to claim 18, wherein the one first region and the second region further comprise a first light-transmitting layer disposed between the dielectric layer and the first conductive element.

* * * * *